United States Patent [19]

Wallhausser et al.

[11] 4,129,506

[45] Dec. 12, 1978

[54] FABRIC SOFTENERS

[75] Inventors: Karl H. Wallhäusser; Ulrich Cuntze; Adolf May, all of Hofheim; Hans-Walter Bücking, Kelkheim, all of Fed. Rep. of Germany

[73] Assignee: Hoechst Aktiengesellschaft, Frankfurt am Main, Fed. Rep. of Germany

[21] Appl. No.: 719,114

[22] Filed: Aug. 31, 1976

[30] Foreign Application Priority Data

Sep. 4, 1975 [DE] Fed. Rep. of Germany ..... 2539349

[51] Int. Cl.[2] ..... D06M 13/40; D06M 13/46

[52] U.S. Cl. ..... 252/8.8; 252/547; 252/548

[58] Field of Search ..... 252/8.8 R, 8.9, 544, 252/547, 548; 260/404, 404.5

[56] References Cited

U.S. PATENT DOCUMENTS

| | | | |
|---|---|---|---|
| 2,238,928 | 4/1941 | Cahn et al. | 260/404 |
| 2,359,043 | 9/1944 | Link et al. | 260/404 |
| 2,525,771 | 10/1950 | Cook et al. | 260/404.5 |
| 2,593,413 | 4/1952 | Cook et al. | 260/404 |
| 2,596,985 | 5/1952 | Cook et al. | 252/8.75 |
| 2,857,330 | 10/1958 | Hall | 252/8.8 |
| 3,028,402 | 4/1962 | Albrecht | 260/404.5 |
| 3,122,504 | 2/1964 | Wedell | 252/8.75 |
| 3,154,489 | 10/1964 | Du Brow et al. | 252/8.75 |
| 3,349,033 | 10/1967 | Zuccarelli | 252/8.75 |
| 3,681,241 | 8/1972 | Rudy | 252/8.75 |
| 3,696,034 | 10/1972 | Hewitt et al. | 252/8.8 |
| 3,775,316 | 11/1973 | Berg et al. | 252/8.8 |
| 3,893,930 | 8/1975 | Sundby et al. | 252/8.8 |

*Primary Examiner*—P.E. Willis, Jr.
*Attorney, Agent, or Firm*—Connolly and Hutz

[57] ABSTRACT

Fabric softening compositions in the form of liquid, aqueous dispersions, containing a condensation product of 1 to 1.5 mols of fatty acid or of a fatty acid ester of the formula I $$R—CO_2X \qquad (I)$$

in which R is an aliphatic radical having about 11 to 21 carbon atoms and X is hydrogen, methyl or ethyl, and 1 mol of an alkylpropylenediaminoxalkylate of the formula II

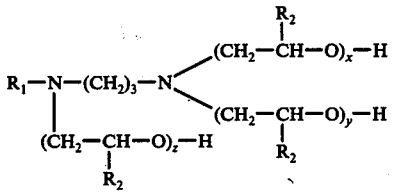

(II)

in which $R_1$ is an aliphatic radical having 12 to 22 carbon atoms and $R_2$ is hydrogen or methyl and x, y and z are 0 or 1, the sum of x, y and z being 1 to 2; and a cationic disinfectant. In addition to their softening properties and on account of their content of quaternary ammonium compounds having disinfecting properties, the fabric softeners of the invention have antimicrobial action.

6 Claims, No Drawings

FABRIC SOFTENERS

The present invention relates to fabric softeners. We know that washed textile material, especially that made of cellulose fibers has an unpleasant hard feel after drying, especially after washing in the washing machine.

It is known that this undesirable hard feel can be eliminated when the textile material, after being washed, is treated in a rinsing bath with cationic substances which contain at least two long-chain aliphatic radicals in the molecule. The fabric softeners available in commerce which contain as active components mostly quaternary dialkyldimethyl-ammonium salts having two longer-chain alkyl radicals in the form of an aqueous dispersion have the drawback that during transport and storage the dispersion thickens because of gel formation, above all when exposed to cooling, especially to freezing temperatures. Neither heating to room temperature nor thorough shaking help to undo this state.

The present invention provides aqueous dispersions of fabric softener formulations stable to cold that contain textile softening agents and anti-microbial quaternary ammonium compounds and optionally further constituents generally used in fabric softeners, for example dyestuffs and perfumes, optical brighteners and nonionic dispersing agents. The fabric softeners according to the invention contain in the form of aqueous dispersions (a) about 1 to 15% by weight, preferably 2 to 6% by weight of a condensation product of about 1 to 1.5 mols, preferably 1 to 1.2 mols of a fatty acid or a fatty acid ester of the formula I $$R-CO_2X \qquad (I)$$

in which R is a preferably saturated aliphatic radical having about 11 to 21 carbon atoms, preferably an alkyl radical having 15 to 17 carbon atoms, and X is hydrogen, methyl or ethyl, with 1 mol of an alkylpropylenediamine-oxalkylate of the general formula II

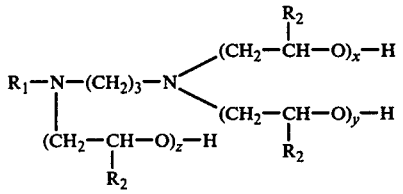

(II)

in which $R_1$ is a preferably saturated aliphatic radical having about 12 to 22 carbon atoms, preferably an alkyl radical having 16 to 18 carbon atoms, $R_2$ is hydrogen or methyl, especially hydrogen and x, y and z each is 1 or 2;

(b) about 1 to 6% by weight, preferably 2 to 4% by weight, of a cationic disinfectant, and optionally, (c) up to about 15% by weight, preferably 1 to 9% by weight of a known quaternary ammonium compound having softening properties in respect of textile material.

The condensation products consisting of compounds of the formulae I and II are above all products in which the radicals R and $R_1$ are alkyl groups. Suitable fabric softeners are also, because of their preparation from mixtures of natural fatty acids, mixtures of condensation products which contain a minor proportion of compounds in which R and/or $R_1$ are alkenyl radicals.

The condensation products of the invention are simply prepared by reacting the alkylpropylenediamine-oxalkylate of the formula II with the fatty acid or its esters in the mole ratio mentioned at temperatures within the range of from about 130° to 250° C., preferably from 160° to 200° C. Depending on the temperature used and the fatty acid component employed, up to 10 hours, mostly about 2 to 8 hours are necessary to achieve the reaction equilibrium. When the condensation takes place under reduced pressure, the reaction can be carried out already at lower temperatures, for example at 120° to 160° C.

Fatty acids for the reactions with the compounds of the formula II are above all saturated fatty acids or fatty acid mixtures which contain minor proportions, at most, of olefinically unsaturated acids. Fatty acids consisting of wholly or partially hydrogenated fats are used above all. Suitable fatty acids are, for example palmitic acid, stearic acid and tallow fatty acid. Esters of these fatty acids are above all those with lower alcohols, especially the ethyl and methyl esters.

When the reaction is finished, the reaction product consisting essentially of a fatty acid amide can be cooled and brought in known manner into different forms, for example the flake form by means of a cooling roller, the granular form by means of an extruder or the powder form by pulverization.

In a variant of this mode of operation the melted mass of the reaction product can be dispersed in water. For this purpose, the melted mass is introduced with stirring, after adjusting a slight alkaline or a slight acid pH, in combination with a water-soluble strong organic or inorganic acid into water or it is introduced into water and the organic or inorganic acid is introduced simultaneously or afterwards. Suitable organic or inorganic acids are above all mineral acids, such as hydrochloric acid, phosphoric acid, sulfuric acid, acetic acid or oxalic acid. The result is an aqueous dispersion which can be diluted with cold water and has a content of up to about 35% by weight of the condensation product.

Constituents of the preparation of the invention acting as disinfectants are the known quaternary ammonium compounds, for example those described in "Soap and Chemistry Specialities", March 1969, pages 47/48.

The following compounds characterized by the formulae VI et VII below are especially used:

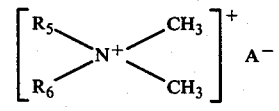

(VI)

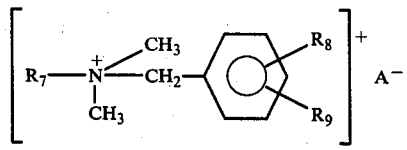

(VII)

In these formulae, $R_5$ and $R_6$ represent alkyl or alkenyl radicals having from 8 to 12 carbon atoms, preferably from 8 to 10 carbon atoms, $R_7$ represents an alkyl or alkenyl radical having from 8 to 18 carbon atoms, preferably from 12 to 16, $R_8$ and $R_9$ represent hydrogen, chlorine or bromine and A represents chlorine, bromine or $CH_3SO_4$, preferably chlorine.

Further cationic softening constituents of the fabric softeners optionally to be added are the quaternary ammonium compounds containing lipophilic radicals, for example those described in "Chemistry and Industry", June 1969, pages 893 to 894.

Textile softeners of this type are especially the compounds characterized by the formulae III b to V below:

(III)

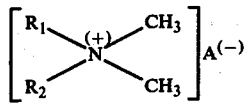

(IV)

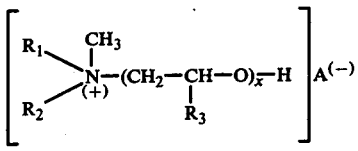

(V)

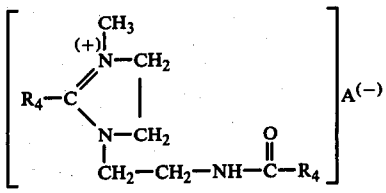

The substituents in these formulae are defined as follows: $R_1$ and $R_2$ are alkyl or alkenyl radicals having from 12 to 20 carbon atoms, which have a C chain distribution such as to be found in the stearic acid, the tallow fatty acid, the oleic acid or the sperm oil fatty acid.

$R_3$ represents hydrogen or a methyl group, $R_4$ represents a preferably saturated aliphatic radical having 13 to 21 carbon atoms, preferably an alkyl radical having 15 to 17 carbon atoms, and x is a number of from 1 to 5, preferably 1;

A may represent Cl, Br or $CH_3SO_4$, preferably Cl.

To prepare the fabric softener according to the invention, the components can be introduced in any desired order into an aqueous phase and dispersed while stirring. To accelerate the dispersion process the aqueous phase can be heated. To stabilize the aqueous dispersion so obtained known non-ionic dispersing agents and emulsifiers may be added.

For the preparation of the fabric softeners, optionally with the addition of non-ionic emulsifiers, the active substances may be melted in combination with the emulsifier to about 70° C. and the melted mass can be mixed with hot water. When textile softeners are used which can be processed in the cold state, it is sufficient to mix the condensation products of compounds of the formulae I and II as aqueous dispersion with the textile softeners IV and V and/or the mixtures thereof in combination with the anti-microbial quaternary ammonium compound, if desired by adding the non-ionic emulsifiers.

The additional use of non-ionic emulsifiers can be advantageous or necessary for a good emulsion of the optical brighteners, the coloring and perfuming agents added to the fabric softener. The non-ionic emulsifiers are mostly used in amounts of up to about 1% by weight, preferably 0.2 to 1% by weight, calculated on the aqueous dispersion of the fabric softener.

Suitable non-ionic dispersing agents or emulsifiers are for this purpose the known surfactants. Among these surfactants are products that own there hydrophilic properties to the presence of polyethyer chains, amineoxide, sulfoxide or phosphineoxide groups, to alkylol amide groupings and generally to an accumulation of hydroxyl groups.

The non-ionic surfactants contain per molecule at least a hydrophobic radical of from 8 to 20 carbon atoms, preferably 10 to 18, and at least one non-ionic hydrosolubilizing group. The preferably saturated hydrophobic radical is mostly of aliphatic or alicyclic nature; it may be bound to the watersolubilizing groups directly or over intermediate members. Intermediate members are for example benzene rings, carboxylic esters or carbon amido groups, radicals of polyvalent alcohols bound like ethers or esters, for example those of the ethylene glycol, the propylene glycol, the glycerol or corresponding polyether radicals.

The products obtained by the addition of about 3 to 40, especially 5 to 20 mols of ethylene oxide to 1 mol of fatty alcohols, alkyl phenols, fatty acids, fatty amines, fatty acid or sulfonic acid amides are of special interest in practice. These polyethyleneglycolether radicals may additionally contain within them or in terminal position propylene or butylene glycol ether radicals or polyether chains.

Further suitable non-ionic emulsifiers are the known, commercial water-soluble addition products of ethylene oxide to water-insoluble polypropylene glycols and addition products of propylene oxide to alkylene diamines or to low aliphatic alcohols containing 1 to 8, preferably 3 to 6 carbon atoms. In these products, the water-insoluble propylene oxide derivatives are the hydrophobic radical.

The fabric softeners of the invention may advantageously be combined with other auxiliaries or additives that have already been used in fabric softeners. For example cationic or non-ionic surface active substances, electrolytes, neutralizing agents, organic complex forming agents, optical brighteners or solution promoters and dyestuffs and perfumes fall in this range. Those additives act, for example on the feel of the material or other properties of the textiles to be treated, on the regulation of the viscosity, the adjustment of the pH or on the increase of the stability to cold of the solutions.

In addition to their softening properties and on account of their content of quaternary ammonium compounds having disinfecting properties, the fabric softeners of the invention have anti-microbial action in the last rinsing bath in the washing machine.

They prevent a growth of the micro-organisms because of their absorption on the textile material.

This germ-inhibitive effect of the fabric softening compositions of the invention is especially desirable because cotton fabrics are nowadays less likely to be boiled and more are washed at 60° C.

The amount of the liquid fabric softening compositions of the invention used is in the usual range of approximately 80 to 120 g per 4 kg of fabric which corresponds as to the softening effect to the same amount of 80 to 120 g of a commercial fabric softener having an active content of 6% by weight based on distearyldimethyl-ammonium chloride.

When the fabric softening compositions of the invention contain mixtures of the condensation products of compounds of the formulae I and II with quaternary ammonium compounds of the type IV and/or V which can be processed in the cold state, the amount to be added in the last rinsing bath must be slightly increased in order to achieve comparable softening effects using a commercial fabric softener based on distearyldimethylammonium chloride.

The following Examples illustrate the invention, the parts and percentages being by weight, unless stated otherwise:

EXAMPLE 1

Preparation of a fabric softener having the following composition:

4% of distearyldimethylammonium chloride

2% of condensation products prepared from 1 mol of stearic acid and 1 mol of N-$\beta$-hydroxyethyl-stearylalkyl-propylenediamine according to the following prescription.

4% of Di-$C_8$-$C_{10}$-alkyl-dimethylammonium chloride 0.5% of an addition product of 12 mols of ethylene oxide to 1 mol of an oleyl alcohol having $C_{14}$-$C_{16}$ carbon atoms as emulsifier perfume, dyestuff, optical brightener and water: ad 100%.

Preparation of the Condensation Product 345 g (1 mol) of an addition compound of 1 mol of ethylene oxide to 1 mol of stearyl propylene diamine and 264 g (1 mol) of stearic acid are condensed during 5 hours at 180° C. while passing through nitrogen and during 2 hours at 165° C. and 25 torr. 576 g of a yellowish product are obtained, (nitrogen content of bases: 2.6%, acid number:0).

The preparation of the fabric softening composition of the invention is effected by melting the active substance having softening effect with the emulsifier at 70° to 80° C. The quaternary ammonium compound having anti-microbial activity is added. The amount of water having the same temperature and being necessary for adjusting the desired concentration is added.

It is recommended to stirr so long until the reaction mixture has cooled to about 50° C.

Perfuming is suitably effected at temperatures within the range of from 40° to 50° C. The products convenient for perfuming are those that are compatible with the cationactive surfactants.

The product according to Example 1 is a stable emulsion and no separation of the phases can be observed neither in the quick test - examination of the stability of the emulsion at 3,500 r.p.m. within 2 hours in the centrifuge — nor in the temperature changing test - examination of the stability of emulsion in determined cycles at +5° C, room temperature and 40° C. during 14 days.

After adjusting to room temperature there is no gel formation. 100 g of the fabric softening composition according to Example 1 are comparable as to their softening effect with about 100 g of a liquid fabric softener available in commerce based on distearyldimethylammonium chloride having a content of active substance of about 6%.

The softening effect of the fabric softening composition is examined by judging the feel of loop pile fabric rags subjected to a corresponding after-treatment.

When examining the disinfecting action the fabric softener according to Example 1 exercises on the fabric sample treated therewith in a washing operation at 60° C. an inhibition zone of more than 2 mm diameter is observed for Staphylococcus aureus and E-coli, and no colony of microorganisms is observed on the fabric sample treated therewith for Pseudomonas aeruginosa.

Whereas a fabric sample washed at 95° C. and subsequently aftertreated with a liquid fabric softening composition available in commerce did not show any growth inhibiting action on microorganisms, the fabric sample after-treated with the liquid fabric softening composition according to Example 1 has germ-reducing properties. The use of the liquid fabric softener according to the invention also acts favorably on the washing liquor of the washing operation at 60° C. where no increase in the growth of microorganisms could be observed. The bacteriostatic tests were carried out according to the inhibition zone test, cf. "Die antimikrobielle Ausrustung von Textilien", Textilveredlung, 1970, pages 3 to 14.

EXAMPLE 2

Preparation of fabric softener dispersion according to Example 1:

(a) 6% of a condensation product prepared from 1 mol of stearic acid and 1 mol of N-$\beta$-hydroxyethyl-stearylalkylpropylene diamine according to Example 1;

4% of Di-$C_8$-$C_{10}$-alkyl-dimethylammonium chloride;

0.5% of an addition product of 12 mols of ethylene oxide to 1 mol of an oleyl alcohol having from 14 to 18 carbon atoms;

perfume, dyestuff, optical brightener and water ad 100%.

(b) 4% of a Di-tallowfattyalkyl-dimethylammonium chloride

2% of a condensation product from 1 mol of stearic acid and 1 mol of N-$\beta$-hydroxyethyl-stearylalkylpropylene diamine according to Example 1;

4% of Di-$C_8$-$C_{10}$-dimethylammonium chloride;

0.5% of an addition product of 12 mols of ethylene oxide to 1 mol of an oleyl alcohol having 14 to 18 carbon atoms;

perfume, dyestuff, optical brightener and water ad 100%.

(c) 4% of Di-tallow-alkyl-monomethyl-monooxipropyl-ammonium chloride;

2% of a condensation product of 1 mol of stearic acid and 1 mol of N-$\beta$-hydroxyethyl-stearylalkylpropylene diamine according to Example 1;

4% of Di-$C_8$-$C_{10}$-alkyl-dimethylammonium chloride;

0.5% of an addition product of 12 mols of ethylene oxide to 1 mol of an oleyl alcohol having from 14 to 18 carbon atoms;

perfume, dyestuff, optical brightener and water ad 100%.

(d) 4% of 1-tallow-alkyl-amido-ethyl-2-tallow-alkyl-3-methylimidazolinium chloride;

2% of a condensation product of 1 mol of stearic acid and 1 mol of N-$\beta$-hydroxyethyl-stearylalkylpropylene diamine according to Example 1;

4% of Di-$C_8$-$C_{10}$-alkyl-dimethylammonium chloride;

0.5% of an addition product of 12 mols of ethylene oxide to 1 mol of an oleyl alcohol having 14 to 18 carbon atoms;

perfume, dyestuff, optical brightener and water ad 100%.

The technical properties of the fabric softening formulations in respect of their stability, feel and germ-inhibitive effect on the textile materials treated therewith are comparable to those of the liquid fabric softening compositions according to Example 1.

What is claimed is:

1. Fabric softening compositions having germ-inhibitive properties in the form of liquid, aqueous dispersions, consisting essentially of (a) 1 to 15% by weight of a condensation product of 1 to 1.5 mols of fatty acid or of a fatty acid ester of the formula I $$R—CO_2X \quad (I)$$

in which R is an aliphatic radical having about 11 to 21 carbon atoms and X is hydrogen, methyl or ethyl, and 1 mol of an alkylpropylenediaminoxalkylate of the formula II

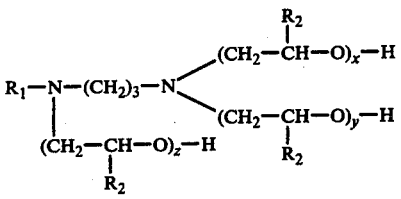

(II)

in which $R_1$ is an aliphatic radical having 12 to 22 carbon atoms and $R_2$ is hydrogen or methyl and x, y and z are 0 or 1, the sum of x, y and z being 1 to 2; and (b) 1 to 6% by weight of a cationic disinfectant.

2. Fabric softening compositions as claimed in claim 1 in which the component a) is a condensation product of a fatty acid or fatty acid ester with 15 to 17 carbon atoms and an alkylpropylenediaminoxalkylate of the formula II wherein $R_1$ is alkyl with 10 to 18 carbon atoms, $R_2$ is hydrogen and x, y and z are 0 or 1, the sum of x, y and z being 1 to 2.

3. Fabric softening compositions as claimed in claim 1, in which the component (a) is a condensation product of about 1 mol of stearic acid with 1 mol of N-β-hydroxyethylstearylalkyl-propylene diamine.

4. Fabric softening compositions as claimed in claim 1, in which the content of condensation products of compounds of the formulae I and II is 2 to 6% by weight.

5. Fabric softening compositions as claimed in claim 1, which contain additionally 0 to 15% by weight of a cationic softening agent, and 0 to 1% by weight of a nonionic dispersing agent.

6. Fabric softening compositions as claimed in claim 5, in which the known cationic softening agents are compounds of the general formulae III, IV and V

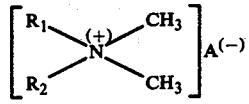

(III)

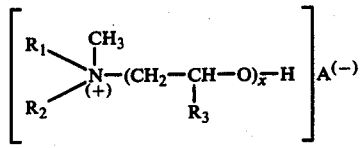

(IV)

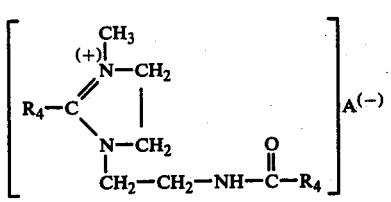

(V)

in which $R_1$ and $R_2$ are alkyl or alkylene radicals having from 12 to 20 carbon atoms, $R_3$ is hydrogen or a methyl group, $R_4$ is a saturated aliphatic radical having from 13 to 21 carbon atoms, x is 1 to 5, A is chlorine, bromine or $CH_3SO_4^{\ominus}$.

* * * * *